US005588649A

United States Patent [19]

Blumberg et al.

[11] Patent Number: 5,588,649

[45] Date of Patent: Dec. 31, 1996

[54] MULTI TOKEN GAMING METHOD

[75] Inventors: Barry B. Blumberg, Yardley, Pa.; James M. Pecka, Mt. Laurel, N.J.; Bruce S. Allen, Feasterville, Pa.

[73] Assignee: CompuScan Technologies, Inc., Delran, N.J.

[21] Appl. No.: 569,318

[22] Filed: Dec. 8, 1995

Related U.S. Application Data

[63] Continuation of Ser. No. 238,237, May 4, 1994, abandoned.

[51] Int. Cl.[6] ..... A63F 9/24

[52] U.S. Cl. ..... 463/18; 463/25

[58] Field of Search ..... 273/138 A, 139, 273/460; 364/410, 411, 412, 403; 235/383

[56] References Cited

U.S. PATENT DOCUMENTS

| | | | |
|---|---|---|---|
| 4,087,092 | 5/1978 | Krause et al. . | |
| 4,213,524 | 7/1980 | Miyashite et al. . | |
| 4,573,954 | 3/1986 | Berger et al. . | |
| 4,586,711 | 5/1986 | Winters et al. . | |
| 4,630,844 | 12/1986 | Troy et al. | 283/67 |
| 4,637,634 | 1/1987 | Troy et al. | 283/98 |
| 4,669,730 | 6/1987 | Small . | |
| 4,671,512 | 6/1987 | Bachman et al. . | |
| 4,764,666 | 8/1988 | Bergeron | 235/380 |
| 4,775,154 | 10/1988 | Clinnin et al. . | |
| 4,781,378 | 11/1988 | Clinnin et al. . | |
| 4,815,741 | 3/1989 | Small | 273/138 A |
| 4,817,949 | 4/1989 | Bachman et al. . | |
| 4,832,341 | 5/1989 | Muller et al. | 273/139 |
| 4,854,590 | 8/1989 | Joliff et al. | 273/138 A |
| 4,875,164 | 10/1989 | Monfort . | |
| 4,882,473 | 11/1989 | Bergeron et al. . | |
| 4,906,826 | 3/1990 | Spencer | 235/379 |
| 4,972,504 | 11/1990 | Daniel, Jr. et al. | 364/403 |
| 4,982,346 | 1/1991 | Girouard et al. . | |
| 4,993,714 | 2/1991 | Golightly | 273/138 A |
| 5,007,641 | 4/1991 | Seidman . | |
| 5,038,022 | 8/1991 | Lucero . | |
| 5,069,453 | 12/1991 | Koza et al. . | |
| 5,080,364 | 1/1992 | Seidman | 273/138 A |
| 5,085,435 | 2/1992 | Rossides . | |
| 5,176,380 | 1/1993 | Evans et al. . | |
| 5,216,595 | 6/1993 | Protheroe | 364/412 |
| 5,217,224 | 7/1993 | Sincok | 273/138 A |
| 5,231,568 | 7/1993 | Cohen et al. | 273/138 A |

FOREIGN PATENT DOCUMENTS

| | | | |
|---|---|---|---|
| 0315611A3 | 10/1989 | European Pat. Off. | G07D 7/00 |
| 2123702 | 6/1982 | United Kingdom . | |
| 2177011 | 1/1987 | United Kingdom | A63F 3/08 |
| WO93/14462 | 7/1993 | WIPO | G06F 15/20 |

OTHER PUBLICATIONS

Employee Motivation Article From Nov. 30, 1991 Incentive Magazine.

*Primary Examiner*—Jessica J. Harrison

*Attorney, Agent, or Firm*—Morgan, Lewis and Bockius LLP

[57] ABSTRACT

A promotional game wherein prizes are automatically and randomly awarded upon presentation of multiple tokens bearing machine readable codes. The random generation of prize awards will take place after the multiple inputs of machine readable codes include a set of inputs which match a preselected set of actuating codes.

43 Claims, 2 Drawing Sheets

MULTI TOKEN GAMING METHOD

This application is a continuation of application Ser. No. 08/238,237, filed May 4, 1994, now abandoned.

FIELD OF THE INVENTION

The present invention relates to promotional gaming methods. More particularly, the present invention relates to a promotional gaming method wherein two or more tokens having a code thereon are entered at a code reading location so that a random selection process will be actuated whereby prizes may be randomly awarded to patrons.

BACKGROUND OF THE INVENTION

Various establishments seek to attract patrons by offering something of value to those prospective patrons who enter the establishment or who purchase particular products. Such offers may be in the nature of a promised free gift to each patron, to be awarded when the patron enters the establishment. In these games, every person entering the establishment, or every person entering the establishment and meeting certain predetermined qualifications, may receive the same gift. Likewise, incentive schemes to induce purchase of particular products or services ordinarily award the same gift to each purchaser.

Other similar schemes utilize an element of random chance. For example, in a so called "match and win" promotion, tokens bearing differing indicia, such as different pictures or combinations of alphanumeric characters may be distributed to prospective patrons. Different prizes are associated with some or all of the different indicia, and the prize associated with each indicia is posted or otherwise made known within the establishment. Thus, the prospective patron must enter the establishment to determine what, if any, prize he has won.

Often, the various indicia include one or more rare indicia applied to only a few of the tokens and associated with prizes of significant value and other common indicia are applied to the remaining tokens and associated with prizes of minimal value or with no prize at all. As only a few patrons will win prizes of significant value, the total value of prizes distributed in the scheme will not pose a prohibitive cost to the sponsor of the scheme. Nonetheless, the possibility, albeit remote, of winning a prize of significant value provides a powerful incentive to prospective patrons.

Although games of this nature can be a useful marketing tool, they suffer from significant drawbacks. In this regard, it is expensive to manufacture and distribute the tokens. Additionally, security measures must be employed to prevent persons involved in distributing the tokens from separating out those tokens bearing the rare indicia associated with valuable prizes and diverting those tokens to their own use. The security measures add to the cost of conducting the game. Moreover, since the game is perceived as being completed after the patron has determined what prize he or she has won, these games provide minimal entertainment to the patron. The game thus has no value whatsoever in inducing the customer to remain in the establishment. Games of this nature normally are not integrated with any mechanism for compiling a list of patrons entering the establishment for use in future promotional efforts.

Other promotional schemes have been conducted using identical tokens, such as identical coupons printed in newspaper advertisements and coupons incorporated as part of packages for goods. Ordinarily, all of the tokens or coupons used in such a scheme are identical and entitle the person holding the coupon to the same value. For example, coupons can be printed in a newspaper offering a discount on a specific item of merchandise in a store. Also, packaged goods often carry coupons which either entitle the customer to a discount on subsequent purchases of the goods or which can be redeemed for unrelated merchandise.

Many of these promotions involve redemption by mail. In such promotions, the coupon or token may be imprinted with a machine readable code or "UPC" code used to identify the goods for inventory and sale purposes. Promotions of this nature generally do not provide any element of randomness. Thus, each consumer may acquire the same item of relatively small value by presenting or redeeming the coupon or token. There is no chance for the consumer to acquire a highly valuable prize and therefore, the promotions usually do not generate much enthusiasm.

A gaming method which has greatly improved upon promotional games is disclosed in U.S. Pat. No. 5,007,641 to Seidman. The promotional game disclosed in the '641 patent provides for automatically awarding prizes upon presentation of tokens which bear machine readable codes. The tokens may be identical to one another. Thus, the tokens may all bear an identical common code. The prizes may be awarded at random to patrons who present an appropriate token bearing such common code. According to the preferred gaming methods disclosed in the '641 patent, prizes may be awarded immediately after presentation and evaluation of the tokens. In one embodiment, the tokens may be product identification code symbols on packages of goods such as film, beer, etc.

The invention disclosed in the '641 patent offers significant improvements over prior art promotional games, and methods of participating in same. Since the prizes are randomly awarded to participating patrons, there are no high-value or low-value tokens, and no need for security measures to safeguard high-value tokens. In the preferred methods of the '641 patent, the gaming method includes the steps of automatically reading codes on tokens presented by patrons at a redemption location within an establishment. The codes read from each of the tokens presented are then automatically compared with one or more predetermined qualifying codes. If a match between any of the presented codes and the predetermined qualifying codes is obtained, the randomization generator is actuated so that prizes will be awarded to at least some of the patrons who presented the tokens bearing a code which matched the predetermined qualifying code.

In one embodiment of the game disclosed in the '641 patent, a patron may need to present a token which includes a code which matches the actuating code, and then must present additional information before the prize awarding randomization generator will be actuated. The additional information typically is specific information regarding the patron, such as the patron's name, address or other specific information regarding the patron.

Although the preferred methods disclosed in the '641 patent provide highly useful and successful games, further improvements are still desirable. In particular, it would be desirable to provide improved games within the broad concept of the '641 patent which provide patrons with even greater motivation to participate in promotional games so that additional revenue will be generated through increased sales or services.

SUMMARY OF THE INVENTION

One aspect of the present invention provides a promotional gaming method comprising the steps of distributing a plurality of tokens to patrons wherein each of the plurality of tokens includes a machine readable code. The plurality of tokens should then be presented so that multiple inputs of the machine readable codes are performed at a code reading location for each patron. Typically, each patron presents multiple tokens. Preferably, the method includes the step of determining if the multiple inputs of the machine readable codes for each patron include a set of inputs which match a preselected set of actuating codes. A random selection process is actuated if the set of inputs for the patron match the predetermined set of actuating codes. Upon actuation of such random selection process, prizes may be randomly awarded to patrons who have presented the tokens for multiple inputting of the machine readable codes which include the set of inputs that match the predetermined set of actuating codes.

Preferably, the tokens include at least one class and each of the tokens bear in each such class a common machine readable code. It is also preferable for the set of inputs to comprise at least two identical codes.

The step of randomly awarding prizes should preferably include assigning prizes of various values to different ones of the patrons who have presented tokens for multiple inputting of the common machine readable codes which includes the set of inputs that match the predetermined set of actuating codes.

In another preferred method, the plurality of tokens are fixed to associated packages of goods and the step of distributing the plurality of tokens includes the step of selling the packages of goods to patrons. In this preferred method, the steps of multiply inputting the machine readable codes and actuating the random selection process responsive thereto for randomly awarding prizes to patrons are performed substantially at the same time of the sale of the packages of goods to patrons. In a further preferred method, the step of automatically reading the codes is performed by automatic data processing equipment and the same automatic data processing equipment may be employed to complete sales transactions by which patrons purchase the packages of goods.

In still a further preferred method, the codes on the plurality of tokens may comprise machine readable product identification codes. In this preferred embodiment, it is also desirable for the plurality of tokens to comprise universal product code symbols.

In an embodiment where all of the packages of goods within the same class are identical to each other, the promotional gaming method of the present invention is designed to entice patrons to purchase two or more packages. For example, the tokens may include universal product code symbols on boxes of a particular brand of pretzels. Each universal product code symbol may be the same. Since the patron must present multiple tokens bearing multiple codes to win, the game can be used to provide unique marketing capabilities. In this example, a set of inputs which include two inputs of the universal product code for the particular brand of pretzels may be chosen to match the actuating code so that the randomization process for awarding prizes to patrons may be actuated. Once the randomization process has been actuated, one prize out of a pool of prizes may be awarded to the patron who purchased two boxes of the particular brand of pretzels.

Alternatively or additionally, the set of plural actuating codes may include two different codes associated with two different items. This allows the promotion to establish a marketing "tie-in" between the two items.

Codes associated with items other than goods can also be employed. For example, a code indicating a credit card issued by a certain banking institution can be used in conjunction with a code indicating particular goods. If the patron buys the specified goods and presents the specified credit card as a means of payment, he or she will have an opportunity to win. Thus, a merchandising tie-in between the credit card and the goods would be established. In one preferred method, at least one of the classes of tokens is affixed to a particular type of credit card. In this preferred method, at least one class of tokens may be affixed to or associated with articles to be purchased by the patron. Alternatively or additionally, at least one additional class of tokens may be affixed to and associated with a particular cash card which may be used at select automated teller machines. In this embodiment, the predetermined set of actuating codes may comprise at least the common machine readable code associated with the credit card, and the machine readable code associated with the article to be purchased by the patron or the cash card to be used, so that the random selection process will be actuated upon inputting of the machine readable codes associated with the particular credit card and either the article or the cash card.

As mentioned above, the plurality of tokens may include two or more classes. The set of inputs which match the actuating code may comprise two or more different codes corresponding to the different classes. For example, the required set of inputs which matches the actuating code may include inputting of the UPC code of Brand X pretzels and subsequently inputting the UPC code on a six-pack of Brand Z soda. Thus, patrons would be enticed to purchase both Brand X pretzels and Brand Z soda before they will be entitled to actuate the random prize generator. In still another preferred embodiment, the set of inputs which match the set of actuating codes may include multiple identical inputs, such as three inputs of the UPC code on a roll of a particular brand of film, or may include inputting of the UPC codes of particular brands of pretzels, soda and cereal. Thus, it is an object of the present invention to entice patrons to purchase more than one item, or use more than one service, upon each visit to an establishment.

These and other objects, features and advantages of the present invention will be more readily apparent from the detailed description of the preferred embodiments set forth below when taken in conjunction with the accompanying drawings.

DETAILED DESCRIPTION OF THE PREFERRED EMBODIMENTS

Figure 1:
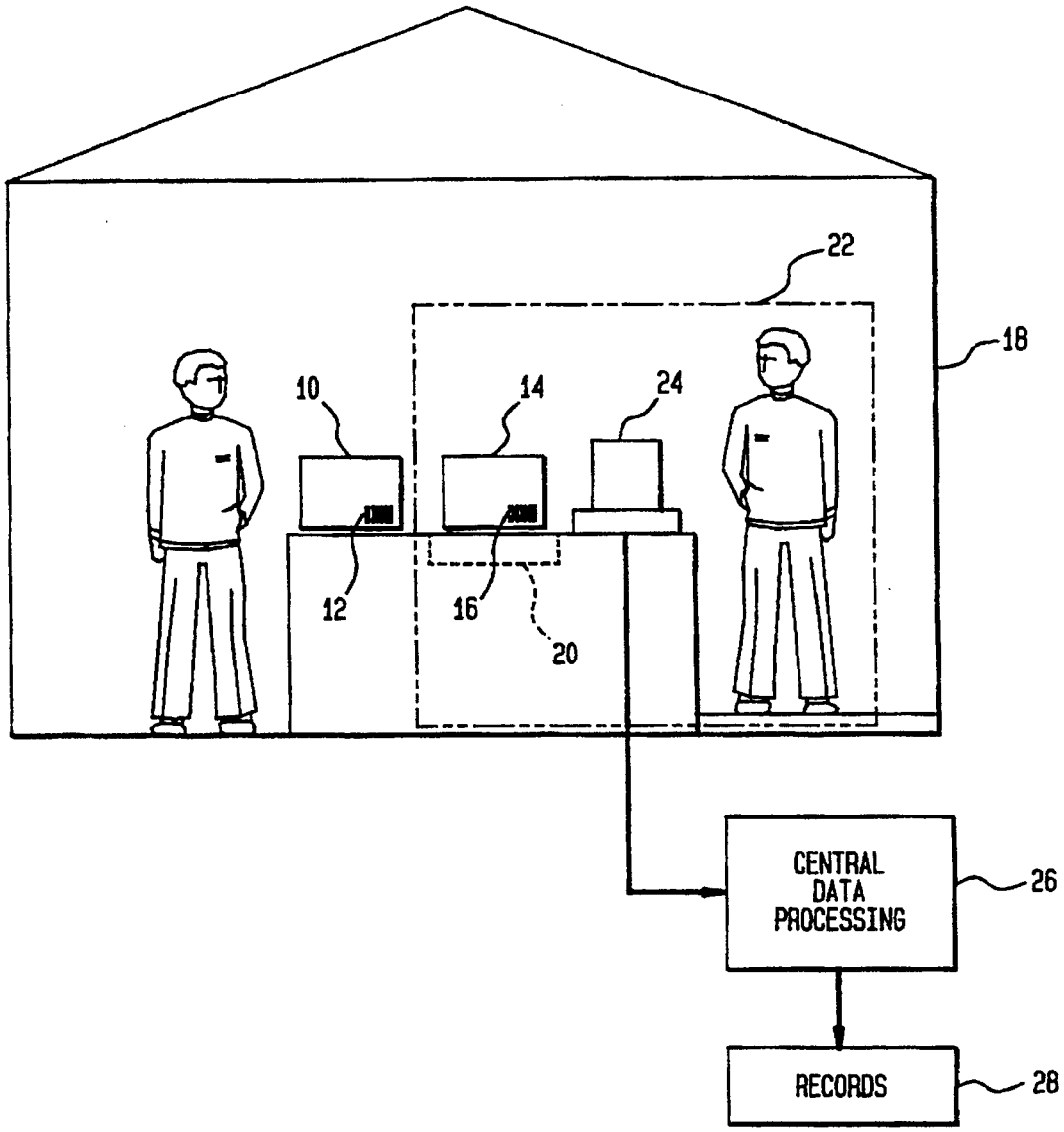
FIG. 1 is a diagrammatic view showing certain elements used in a gaming method according to one embodiment of the invention.

A gaming method in accordance with one embodiment of the present invention is intended to entice patrons to purchase multiple items, or utilize multiple services, upon each trip to an establishment 18 having a code reading location 22. In the preferred embodiments discussed herein, the establishment 18 may comprise a supermarket, other retail establishment, or miscellaneous code reading locations. The establishment 18 may have one or more code reading locations 22 which may include an optical bar code reader 20. In other preferred embodiments, the optical bar code reader 20 may be replaced by various types of scanners or other electronic, optical, or other entry devices which are adapted to receive codes from tokens. The optical bar code reader 20 may be used in conjunction with a computer 24 including a data entry terminal. The data entry terminal may be a standard terminal of the type used as a retail point of sale terminal such as the terminal sold under the IBM 468X, i.e. 4681, etc., or NCR 2127, 7000 and the like. The bar code reader 20 and other input or output devices may be standard devices of the type used with the aforementioned type of terminal.

As noted above, each establishment 18 may include numerous code reading locations 22. Each of the code reading locations 22 are provided with similar data processing computers 24 and display signs (not shown). The computer 24 may be electronically linked to a selectively operable illuminated sign or other selectively operable display device arranged to display a message including words such as "winner", "game play in process" and "jackpot" or the like indicating that someone has won a high valued prize or that someone is presently playing the game. Use of such a display sign will increase the level of excitement and enthusiasm among patrons who participate in the promotional game of the present invention. The data processing computers 24 at each redemption location 22 may be connected via standard data linkages to a central data processing unit 26, such as a central digital computer which may have a standard design. The central data processing unit 26 may similarly be linked to a storage device 28, which may be a standard type storage device such as a disk or tape drive.

The promotional game shown in FIG. 1 is preferably played by selecting and purchasing two or more products at a retail establishment 18, such as a supermarket. The particular products selected by a sponsor to be included within the present promotional game will vary. However, in preferred methods, the present game will require a patron to purchase two or more products, such as a box of pretzels 10 and a six-pack of soda 14 and to present the tokens thereon 12 and 16, respectively, to an optical bar code reader 20 which acknowledges that the pretzels 10 and the soda 14 have been purchased by the patron. The optical bar code reader 20 scans the entry of the tokens 12 and 16, which may be in the form of universal product codes ("UPC" codes) which identify the particular products purchased. Thus, in a preferred embodiment, the token 12 is the UPC code affixed to the package 10 and the token 16 is also the UPC code affixed to the package 14 of retail products, which are identified in FIG. 1 as pretzels and soda, respectively. As can be appreciated, the use of UPC codes to identify products purchased in retail establishments such as a supermarket 18, is a common means of identifying the type of goods sold for both point of sale and inventory purposes.

Typically, each UPC code is associated with a specific product. Thus, the UPC code 12 associated with a product such as pretzels 10 will be different than the UPC code 16 associated with a particular type of soda 14. Thus, if the promotional gaming method of the present invention is designed to entice patrons to purchase a box of Brand X pretzels and a six-pack of a Brand Z soda, the central data processing unit 26 must be pre-programmed with a set of actuating codes that corresponds with the UPC codes 12 and 16.

The range of products which may be promoted in accordance with the game of the present invention is not limited to different products. Thus, if a sponsor wishes to promote multiple sales of the same product, such as the sale of two or more boxes of pretzels, the central data processor 26 would be pre-programmed so that the set of actuating codes correspond to at least two entries of token 12.

Perspective patrons may be notified of the present promotional game by advertisements, radio, newspapers, product packages, flyers, point of purchase displays and the like.

In the embodiment of the present invention where a patron must purchase one box of Brand X pretzels 10 and one six-pack of Brand Z soda 14 within the same shopping trip in order to be eligible to win a prize, the packages 10 and 14 bearing tokens 12 and 16 may be distributed in the ordinary fashion within a retail establishment 18.

Figure 2:
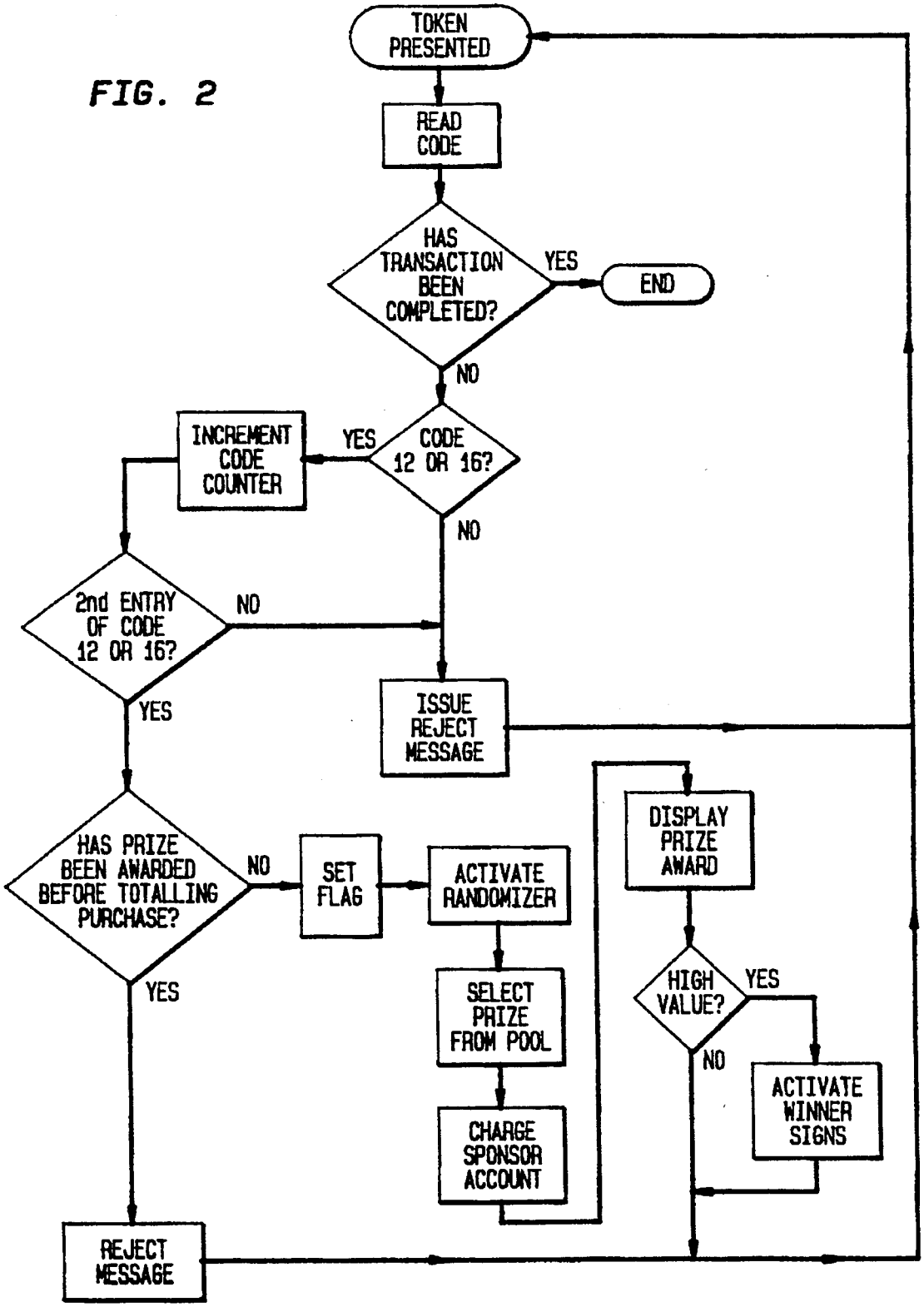
FIG. 2 is a flow chart depicting certain steps and operations according to the gaming method of FIG. 1.

Thus, patrons may select the promoted products from the shelves within the establishment 18. In order to play the game, the patrons must take the required products 10 and 14 to one of the code reading locations 22, such as a check-out counter, within the retail establishment 18. The optical bar code reader 20 will scan the UPC codes of all products purchased by the patron. The computer 24 at the checkout station has a memory so that each time the UPC code of a product is scanned in by the optical bar code reader 20, it retains such information. Software which may be written in any suitable computer language is used in conjunction with computer 24 to process the inputted UPC codes. Execution of the software program may begin upon initiation of the promotional game. The program will run a new cycle each time a different UPC code is scanned by the optical bar code reader 20 into the processing unit within the computer 24. A flow chart of the cyclical program that will be executed by the computer 24 is schematically shown in FIG. 2.

As a first step, the optical bar code reader 20 automatically scans the UPC code of each product presented. After each code is read by the computer, the program will check to see if the particular patron's transactions have been completed. In this regard, as soon as the last token presented by a particular patron has been inputted, and same has been totalled, the program will automatically reset itself and re-initialize the various flags discussed below. This will assure that prizes are not erroneously awarded to consecutive patrons who do not purchase all of the required products or use all of the required services. In the particular situation where the promotional game of the present invention is being played in a supermarket, the program will be reset each time the check-out clerk totals the purchases of a patron.

The program will not execute the random prize generation steps unless the entered UPC codes constitute a set which matches predetermined set of actuating codes. In the present example, such predetermined set of actuating codes would be the set of UPC codes identified by tokens 12 and 16. Thus, the random prize generator will not be actuated until both tokens 12 and 16 have been scanned into the computer 24 via optical bar code reader 20 in a sales transaction, i.e., before flags are reset. If a token including UPC code 12 or 16 is not presented, the computer will then return to the next reading step to read the next token, without further action. However, if the token bearing UPC code 12 or 16 is entered, the program will set a flag indicative of that code. After setting the flag, the computer will then check to see if flags for both codes 12 and 16 have been set. If the answer is no, the computer will again loop back to read the next code. However, if the answer is yes, the computer will recognize that the inputted tokens include a set of codes which match the predetermined set of actuating codes. The steps of the program which governs activation of the randomization generator may be modified depending on the particular promotion being run. For instance, it may be designed only to activate the randomization generator after a patron purchases two boxes of Brand X pretzels, or two six-packs of Brand Z soda, or one of each, or numerous combinations of products and amounts of products.

Optionally, the sponsor may wish to limit the distribution of prizes to one prize for each patron per shopping trip. In this embodiment, the computer will then check to see if a prize has been awarded before totalling the patron's purchase. If it determines that a prize has already been awarded, it will generate a reject message and the program will end, until the next reset, i.e., until the next patron. If, however, it determines that codes from the inputted tokens 12 and 16 match the preselected set of actuating codes and that no prize has yet been awarded to the patron (since the last reset), it will then proceed to the next step in the program. It will set a "prize awarded" flag, to now indicate that a prize has been awarded, and then activate the randomizing program to select either a prize or no prize. As a further option, the promotional game may be designed to limit prize awards to a total number of prizes over the course of the game, or to limit prize awards by prize value, etc. Such customized features can be accomplished by advertising and software modifications.

If desired, the program may be designed to generate a message to those patrons who have purchased only one of the required products. For example, if the randomization generator is programmed to be activated after a patron purchases two boxes of Brand X pretzels and the patron only purchases one box of Brand X pretzels, by the time that the order is totalled, the program may generate a message advising the patron that he or she almost won but needed to purchase one additional box of Brand X pretzels. This optional feature may further entice patrons to purchase multiple products during future shopping trips.

The random selection process can be performed by generating a random number through standard random number generation techniques used in data processing and then comparing that random number with preset ranges, each associated with a particular prize. The prize that will be awarded to any particular patron who presents a set of tokens to be inputted which match the preselected set of actuating codes 12 and 16, is determined solely by the randomization process and by the preset ranges associated with the prize pool. It should be appreciated that the prize to be awarded to such patron is determined only after the patron has presented the tokens 12 and 16 for multiple inputting thereof. Thus, the patron receives substantially instant gratification in the nature of knowing any prize which he or she has won immediately after scanning has taken place.

Although various random number generation techniques may be utilized in accordance with the present invention, one preferred method contemplates playing the promotional game with one or more data files which are created at the start of the game. Each data file includes a play count specifying a number of play locations. The total number of play locations specified by all files is equal to the total number of game plays which will be allowed. At the start of the game, a fixed number of prizes, typically including several different prize values are randomly seeded to one or more data files until the supply of files is exhausted. Any one prize is preferably seeded to only one data file. The seeding process is completed by associating play location numbers in each data file with prize values assigned to that data file. The assignment of prizes to play location numbers starts with the lowest play locations in the file, and with the highest-value prizes in the file, so that locations which may be designated 1 through $N_1$ will be associated with first prizes; locations $(N_1+1)$ through $N_2$ will be associated with second prizes, and so on to the last prize category, with $N_{last}$. The prizes, and the notations in the data file denoting the associations of prizes to play locations, are not unique. For example, a notation associating a predetermined number of play locations with a second prize, may occur in one file, or in many different data files. These data files are supplied to the computer 24 in encrypted form.

When a player presents the required number of tokens having actuating codes thereon, a random number is generated. This random number is then converted by a modular division process to a pointer integer having a value between 1 and the play count in the data file. The location indicator by the pointer integer is compared with the play numbers associated with the prizes. If the location indicator by the pointer integer has a prize associated with it, the player wins that prize. If not, the player loses. Thus, if the pointer integer is greater than $N_{last}$, the player loses. If the pointer integer is between $N_1$ and $N_2$, the player wins a designated second prize; if the pointer integer is between $N_2$ and $N_3$, the player may win a designated third prize. There is no comparison between any code on the token presented by the player and any code in the data file. Following play, the play count is decremented. Also if the last play resulted in a win, the prize that was won may be deleted from the data file by decrementing N for the category of prizes won and for all lesser-value (higher location) categories, so that $N_{last}$ decreases on every win. When the play count in the data file for a particular system reaches zero, no further game plays are available on that system.

When a process, such as that discussed in the preceding paragraph is used, a large number of random numbers are generally required. Such a large number may be achieved by utilizing two random number generators instead of one. The first random number generator may use three random numbers seeded by selected time numbers. The second random number generator may be based on the sum of the minutes, seconds and hundredths of seconds of the current time of day and the result of the first random number generator. The resulting sum of the time components and the first random number is divided by a number representing the number of scans which remains. The integer remainder of that quotient is then employed in a comparison with a figure which represents the number of prizes remaining to determine if a particular player is a winner or a loser.

In order to limit the distribution of valuable prizes, the program can be designed to remove certain prizes from the prize pool after those prizes have been awarded. For example, the promotional game may advertise that ten patrons will win a particular type of car. In this instance, the program will be initially set to distribute up to ten cars. When the randomization generator is activated, a patron will have an opportunity to win one of the ten cars in the prize pool. However, each time one of the cars is awarded as a prize, the program will automatically decrease, by one, the number of available cars in the prize pool.

The program may also include commands to test the value of the prize awarded against some predetermined criteria of value and, if the value exceeds that predetermined criteria, to actuate an indicator (not shown) so that other patrons can be made aware that someone has won a high valued prize. This optional feature of the present invention may facilitate excitement and enthusiasm of other patrons within the establishment to purchase the required product so that they may also participate in the promotional game.

In the next operation along this branch of the program, the data processing apparatus optionally charges the account of a sponsor associated with the preselected set of actuating codes. When the preselected set includes the UPC codes identified by tokens 12 and 16, which are distributed as part of the packages 10 and 14, the sponsor who typically will be the manufacturer or distributor of the goods, will be charged. By automatically charging the sponsor's account whenever an inputted set of codes matches the preselected set of actuating codes, the system can charge the sponsor in an amount proportional to the results achieved, i.e., in an amount proportional to the number of packages of pretzels 10 and soda 14 which the sponsor has sold to persons participating in the promotional game. The program may also be adapted to record valuable store-specific information for the sponsor. This additional data may include information regarding the particular store in which a prize is awarded, the time of the award, the cashier who inputted the winning code, etc.

To assure that accurate records regarding the amount of prizes awarded and the success of the game are obtained, the central data processor 26 can be periodically updated. If the data processing equipment of the present invention is hard wired, the central data processor 26 can be automatically updated each time a product bearing a token is scanned into the computer 24 by the optical bar code reader 20. Optionally, the data processing equipment of the present invention to be linked to a central record location 28 which may be a disk drive or a tape drive where permanent records may be kept.

The promotional gaming method in accordance with the present invention may be varied in almost innumerable ways. One very significant advantage of games in accordance with the invention is that the games may be varied simply by reprogramming the data processing apparatus. In particular, the products which are to be promoted by playing the present game may vary from time to time. For example, the promoted products may vary on a weekly or a monthly basis. When it is desirable to direct the promotional excitement of the present game toward new products, computer 24 can simply be reprogrammed by redefining the set of predetermined actuating codes. Regardless of the particular type of products that will be marketed in accordance with the present promotional game, the predetermined set of actuating codes should include at least two codes, which may be identical, and which must be inputted and matched with this predetermined set before the random prize generator will be actuated.

When the newly programmed codes match universal product codes of different products, or other standard product identifying codes on packaged goods, the game can be revised to establish a marketing tie-in with a new sponsor almost immediately. Thus, in the game as described above, the purchase of a package of Brand X pretzels 10 and a six-pack of Brand Z soda 14 provides a patron with tokens 12 and 16 which match the predetermined set of actuating codes to enter the game. However, the central data processor 26 and the computer 24 can be reprogrammed to accommodate the UPC codes on goods manufactured by various suppliers. Accordingly, the game can be revised almost instantaneously to establish a new marketing strategy in which the owners of the establishment 18 will work with different suppliers of packaged goods. To establish such a new marketing strategy, there is no need to distribute specially marked packages or other special tokens. Likewise, there is no need to dispose of obsolete packages bearing offers or codes which are no longer valid. The cost of printing special packages is entirely obviated. If desired, any or all of the token types discussed above can be eliminated. In its simplest form, the game can be played using only a single type of token, and will be actuated upon a predetermined number of multiple inputs of such token. This would correspond to multiple purchases of the same product, such as two packages of pretzels 10.

In the specific embodiments of the present invention discussed above, the code reading location 22 within an establishment 18 simultaneously performs the code reading and prize awarding steps, usually at the point of sale of the packages on which the tokens are affixed. However, in other embodiments of the present invention, the data processing equipment may be arranged at code reading locations which are not adapted to handle the simultaneous point of sale activities that have been described above. One example of a promotional game of this type is the use of an ATM machine to obtain cash. As with the previously described embodiments, proper operation of the game requires multiple inputting of tokens until tokens including a set of codes which match a predetermined set of actuating codes have been entered.

For example, the promotional aspect behind the game may be sponsored by a credit card company such as Mastercard®, Visa®, American Express®, Discover®, etc. The goal of a promotional game according to this embodiment would be to have a patron prove that he or she is an owner of the particular type of credit card being promoted. In this regard, whenever a patron desires to use an ATM machine including data processing equipment in accordance with the present invention, the player will be required to insert both his or her usual type of cash card, and then to subsequently insert the appropriate credit card into the ATM machine. In accordance with this embodiment, the program will acknowledge the set of inputs including the entry of the cash card, bearing a code associated with a particular bank, and the subsequent entry of a particular type of credit card, bearing a code indicative of the associated credit card company. After both cards have been entered, the program will acknowledge the match between the set which has been inputted and the predetermined actuating set. The sponsor's account will then be charged, a prize will be selected from the pool and will be awarded to a patron in accordance with the steps described above.

As can be appreciated, laws bearing on gambling and the lotteries limit certain types of promotions involving an element of chance. This is particularly true where a purchase of goods or services is required as a precondition for entry in the game. Games according to the present invention can be, and are intended to be, operated in full conformance with the applicable state and federal laws. Such laws ordinarily require that the patron or prospective patron be allowed to enter any game of chance without purchasing anything or paying money to acquire an entry. Ordinarily, such laws are satisfied if the patron has the opportunity to acquire a game token without a purchase. For example, where portions of packages bearing product identification codes are employed as gaming tokens, the patron or prospective patron may be afforded an opportunity to acquire gaming tokens by some means which does not involve purchase, as by writing a letter to the sponsor of the game requesting tokens.

It should be appreciated that numerous variations and combinations of the features described above can be utilized without departing from the present invention as defined by the claims set forth below. Accordingly, the foregoing description of the preferred embodiments should be taken by way of illustration rather than by way of limitation.

What is claimed is:

1. A promotional gaming method for enticing a patron to purchase at least two products that are being promoted by an establishment using an electronic promotional system, the products including a good or a service, the method comprising the steps of:

distributing a plurality of tokens to a patron of the establishment, each of said plurality of tokens being associated with a product and including a machine readable code;

presenting by the patron at least two of said plurality of tokens at a code reading location in the electronic promotional system;

reading said machine readable codes on said at least two tokens presented by said patron at said code reading location by said electronic promotional system to thereby provide a group of inputs;

determining by said electronic promotional system if said group of inputs for each patron includes a set of inputs matching a preselected set of actuating codes, said preselected set of actuating codes corresponding to one or more products which are being promoted by the establishment; and actuating a random selection process if said set of inputs matches said predetermined set of actuating codes so as to randomly award prizes only to patrons who have presented tokens with machine readable codes that match said predetermined set of actuating codes, whereby a patron who purchases at least two products which are being promoted is rewarded with am opportunity to win a prize.

2. The promotional gaming method of claim 1 wherein said plurality of tokens include at least one class, all of said tokens in said at least class bearing the same common machine readable code.

3. The promotional gaming method of claim 2 wherein said predetermined set of actuating codes comprises two identical codes.

4. The promotional gaming method of claim 2 wherein said predetermined set of actuating codes comprises two different codes.

5. The promotional gaming method of claim 2 wherein said step of randomly awarding prizes includes assigning prizes of various values to different patrons who have presented tokens inputting with codes that match said predetermined set of actuating codes.

6. The promotional gaming method of claim 2 wherein said at least one class of tokens includes credit cards, and said step of presenting at least two of said plurality of tokens includes the substep of presenting a credit card to said code reading location.

7. The promotional gaming method of claim 6 wherein a second class of tokens is affixed to articles to be purchased by said patrons, said predetermined set of actuating codes comprising the machine readable code associated with said credit card and the machine readable code associated with said article to be purchased by said patron, whereby said random selection process will be actuated upon inputting of said machine readable codes associated with said credit card and said article.

8. The promotional gaming method of claim 6 wherein a second class of tokens includes cash cards adapted to be used at an automated teller machine, said predetermined set of actuating codes comprising the machine readable code associated with said credit card and the machine readable code associated with said cash card, whereby said random selection process will be actuated upon inputting of said machine readable codes associated with said credit card and said cash card.

9. The promotional gaming method of claim 2 wherein said plurality of tokens are affixed to associated packages of goods, said step of distributing said plurality of tokens including the step of selling said packages of goods to patrons.

10. The promotional gaming method of claim 9 wherein said steps of reading said machine readable codes and actuating a random selection process responsive thereto for randomly awarding prizes to patrons are performed substantially concomitantly with the sale of said packages of goods to patrons.

11. The promotional gaming method of claim 10 wherein said step of automatically reading said codes is performed by automatic data processing equipment and the same automatic data processing equipment is employed to process sale transactions by which patrons purchase said packages of goods.

12. The promotional gaming method of claim 9 wherein said codes on said plurality of tokens are machine readable product identification codes.

13. The promotional gaming method of claim 10 wherein each of said plurality of tokens is a universal product code symbol.

14. The promotional gaming method of claim 9 wherein all of the packages of goods within the same class are identical to each other.

15. The promotional gaming method of claim 2 wherein said at least one class comprises a plurality of subclasses, said plurality of tokens in each of said plurality of subclasses bearing common machine readable codes unique to associated ones of said plurality of subclasses.

16. The promotional gaming method of claim 15 wherein said group of inputs comprises two different codes.

17. The promotional gaming method of claim 15 wherein said step of randomly awarding prizes includes randomly awarding prizes of various values to different ones of the patrons who have presented tokens bearing codes that match said predetermined set of actuating codes.

18. The promotional gaming method of claim 15 wherein said plurality of tokens are affixed to associated packages of goods, said step of distributing said plurality of tokens including the step of selling said packages of goods to patrons.

19. The promotional gaming method of claim 18 wherein said steps of reading said machine readable codes and actuating a random selection process are performed substantially concomitantly with the sale of said packages of goods to patrons.

20. The promotional gaming method of claim 19 wherein said step of reading said machine readable codes is performed by automatic data processing equipment and the same automatic data processing equipment is employed to process sale transactions by which patrons purchase said packages of goods.

21. The promotional gaming method of claim 18 wherein said codes on said plurality of tokens are machine readable product identification codes.

22. The promotional gaming method of claim 21 wherein each of said plurality of tokens is a universal product code symbol.

23. The promotional gaming method of claim 18 wherein all of said packages of goods within the same sub class are identical to each other.

24. The promotional gaming method of claim 18 wherein said steps of actuating a random selection process and randomly awarding prizes to patrons are performed substantially immediately upon presentation of said tokens.

25. The promotional gaming method of claim 1 wherein said steps of actuating a random selection process and randomly awarding prizes are performed substantially immediately upon presentation of said plurality of tokens to the code reading location.

26. The promotional gaming method of claim 1 further comprising the step of notifying a patron that a prize has not been won based upon the result of the step of randomly awarding prizes.

27. A promotional gaming apparatus for enticing a patron to purchase at least two products that are being promoted by an establishment, the products including a good or a service, comprising:

means for reading a code from a token corresponding to a product and for generating a signal corresponding to the code;

computer means, connected to said reading means, for receiving the signal and storing the code, and for processing the code to produce an output signal, said computer means comprising:

means for determining whether the code and a previously input code match a preselected set of actuating codes, said preselected set of actuating codes corresponding to a desired set of products which are promoted together;

means for generating a random number if a match is found by said determining means; and means for comparing the random number to a predetermined range of numbers to determine if a prize is to be awarded to the patron, and for generating the output signal if the comparison is favorable; and output means, connected to said computer means, for producing in response to the output signal a display output to the patron indicating that the patron has won a prize.

28. The promotional gaming apparatus of claim 27 wherein said token includes a machine readable code located on a good offered for sale by the establishment.

29. The promotional gaming apparatus of claim 27 wherein said token includes a machine readable code located on a card.

30. The promotional gaming apparatus of claim 29 wherein said card comprises a card from a banking institution.

31. The promotional gaming apparatus of claim 27 wherein the preselected set of actuating codes corresponds to one product so that a match is found by said determining means when at least two of said one product is purchased by the patron.

32. The promotional gaming apparatus of claim 27 wherein the preselected set of actuating codes corresponds to at least two products so that a match is found by said determining means when both a good is purchased by the patron and a service is utilized by the patron.

33. The promotional gaming apparatus of claim 27 wherein said reading means includes an optical bar code reader.

34. The promotional gaming apparatus of claim 27 wherein said output means comprises a display sign.

35. The promotional gaming apparatus of claim 27 wherein said computer means further comprises a means for storing data generated by said computer means.

36. The promotional gaming apparatus of claim 27 wherein said computer means further comprises prevention means for determining when a preselected number of prizes have been awarded and for preventing any further prizes from being awarded when the preselected number has been exceeded.

37. The promotional gaming apparatus of claim 27 wherein said computer means further comprises message means for generating a message when an additional token is needed to allow said determining means to find a match, and wherein said output means displays said message to inform the patron that an additional token is needed for a chance to win a prize.

38. The promotional gaming apparatus of claim 27 wherein the predetermined range of numbers is divided into a plurality of play locations, and wherein one of a plurality of different prizes is associated with one of the play locations.

39. The promotional gaming apparatus of claim 38 wherein a first place prize is associated with a first group of play locations and a second place prize is associated with a second group of play locations.

40. The promotional gaming apparatus of claim 39 wherein said output means produces a display message indicating a first place prize has been won.

41. The promotional gaming apparatus of claim 27 wherein said computer means generates sponsor account debit information when the comparing means determines that a prize is to be awarded, the sponsor account debit information being stored by said computer means and indicating a sponsor associated with one of the tokens provided to the reading means by the patron, whereby a sponsor can be charged for a prize awarded to a patron who has purchased a product of the sponsor.

42. The promotional gaming apparatus of claim 27 wherein said computer means generates transaction specific information when the comparing means determines that a prize is to be awarded, the transaction specific information being stored by said computer means and including information specific to the patron presently using the gaming apparatus.

43. The promotional gaming apparatus of claim 41 wherein the transaction information includes information identifying a particular store where the gaming apparatus is located.

* * * * *